United States Patent [19]

Kolbel

[11] 4,376,533

[45] Mar. 15, 1983

[54] PUSH AND PULL TYPE EXERCISING DEVICE

[75] Inventor: Gert F. Kolbel, Hanover, Fed. Rep. of Germany

[73] Assignee: Compret N.V., Amsterdam, Netherlands

[21] Appl. No.: 267,112

[22] Filed: May 26, 1981

[30] Foreign Application Priority Data

Jun. 4, 1980 [GB] United Kingdom ..... 8018265

[51] Int. Cl.[3] ..... A63B 21/02; A63B 21/32

[52] U.S. Cl. ..... 272/137; 272/141; 272/143

[58] Field of Search ..... 272/137, 141, 139, 142, 272/143

[56] References Cited

U.S. PATENT DOCUMENTS 3,268,225 8/1966 Kolbel ..... 272/137

4,220,328 9/1980 Crush ..... 272/143 X 4,245,840 1/1981 Van Housen ..... 272/137

4,290,600 9/1981 Kolbel ..... 272/137

FOREIGN PATENT DOCUMENTS 69466 11/1958 France ..... 272/143

*Primary Examiner*—George J. Marlo

*Attorney, Agent, or Firm*—Blum, Kaplan, Friedman, Silberman and Beran

[57] ABSTRACT

In a physical exerciser of the push and pull type in which an elongate telescopic system is contractable against the force of a spring by pushing handles together or by pulling apart tension elements connecting the handles, the improvement that the ends of the tension elements pass round guide pulleys and are connected to loops so that additional exercises and greater movements can be performed by pulling on the loops with the hands or feet.

6 Claims, 16 Drawing Figures

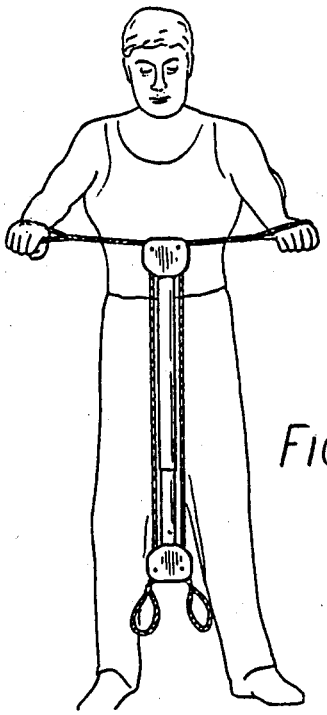
FIG. 3J
FIG. 3K
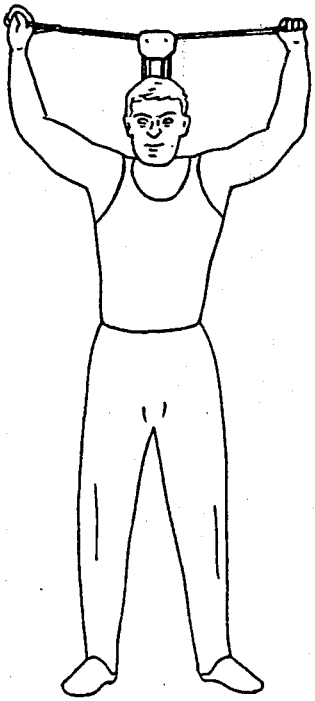
FIG. 3L
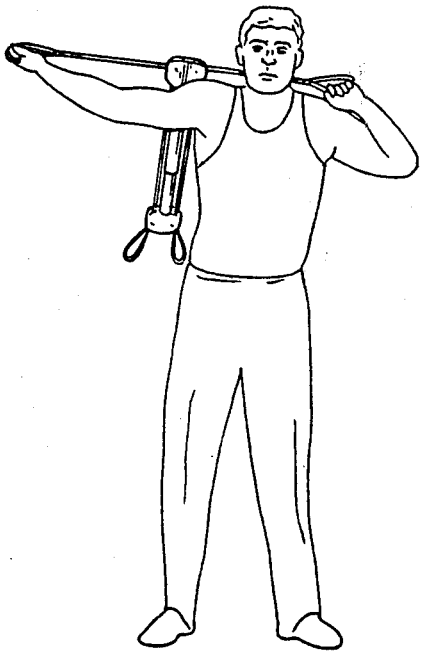

PUSH AND PULL TYPE EXERCISING DEVICE

BACKGROUND OF THE INVENTION

The invention relates to a Physical Exercising device of the type described in my U.S. Pat. No. 3,268,225 which allows both pushing and pulling exercises to be achieved on a single exerciser. In the above-mentioned Patent Specification there is described an exerciser involving a telescopic system including a spring so that as the telescopic system is contracted the spring is placed under compression. Tension elements in the form of ropes connect the handles at the ends of the telescopic system so that as the ropes on the opposite sides of the system are pulled apart the spring is placed under compression. In use certain exercises comprise applying a pushing force to the handles at each end and certain exercises comprise pulling the two runs of rope apart and again placing the spring under compression. In this way the exercises bring into play different muscles involving forces of both compression and tension while the work by the person using the exerciser always acts on the same spring to place it under compression.

Such an exerciser allows a considerable number of muscles to be exercised but does not allow development of all the muscles of the body or allow the exercise of those muscles over a sufficiently wide range of positions.

SUMMARY OF THE INVENTION

An object of the present invention is to provide an exerciser which increases the number of possible exercises and the positions in which exercises can be done and allows additional muscles to be exercised.

It is important in exercising the body that the muscles are exercised over a considerable movement distance and not just in one position or a small range of positions. It is another object of the invention to extend the movement distance through which exercises can be performed.

Accordingly the present invention provides a physical exerciser for push and pull exercises comprising an elongate telescopic system, the system being contractable longitudinally by the application of manual pressure, resilient biasing means arranged to resist contraction of the system, a pair of flexible substantially inextensible tension elements on opposite sides of the system connecting the ends of the system so that pulling apart of the tension elements on opposite sides of the system contracts the system against the biasing means, at least two tension element ends each passing round an associated guide means and being attached to stop means restraining that end from moving towards the centre of the system, and a separate unrestrained pull member connected to each such end, such that pulling on a pull member moves the associated tension element around the guide means to contract the system.

Preferably the pull members will be in the form of loops and there will be four guide members and pull members one associated with each end of each tension element.

With such an exerciser all the known exercises can be performed in the known manner either pushing the ends of the telescopic system together or gripping the centre portions of the runs of the tension elements and pulling them apart. However, in addition, the hands or feet or both can be inserted in selected ones of the loops and a great many additional exercises can be performed or existing exercises can be performed over a greater movement distance.

DETAILED DESCRIPTION OF EMBODIMENT OF THE INVENTION

Figure 1:
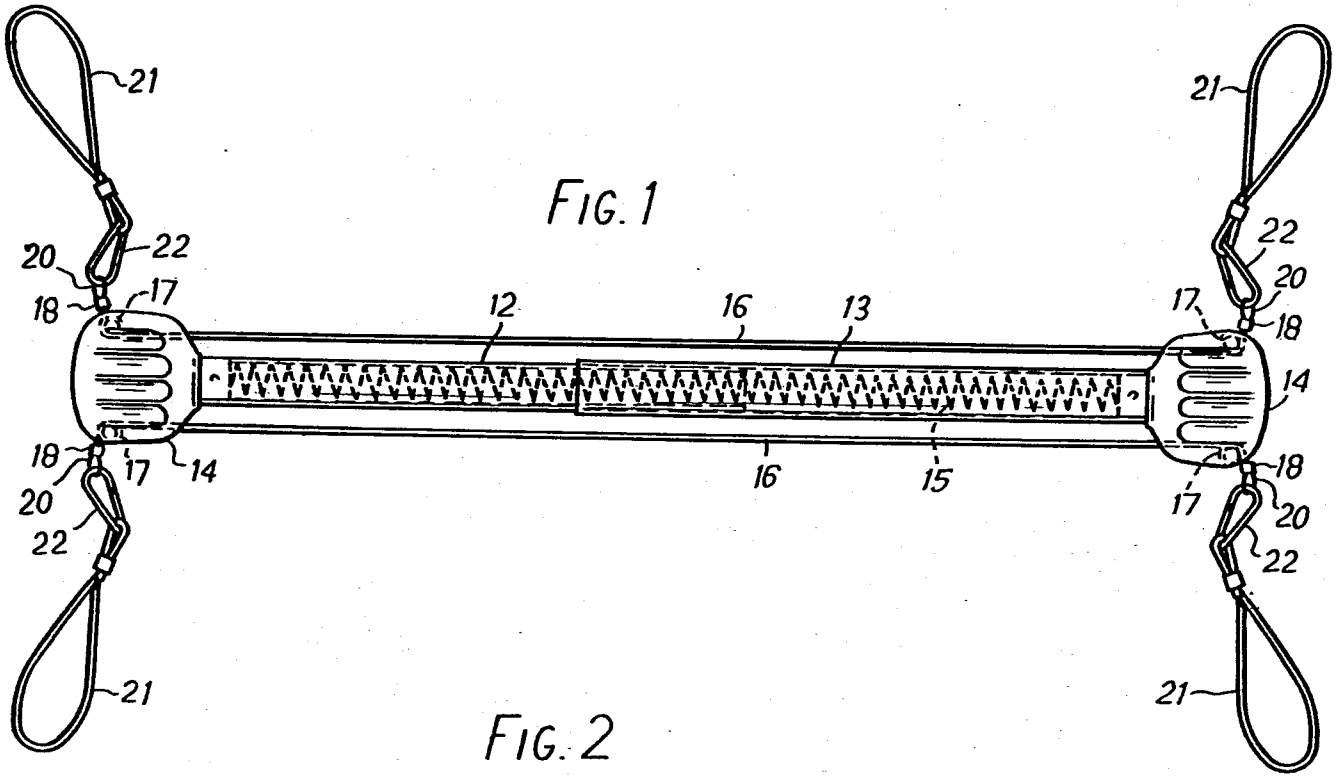
Figure 2:
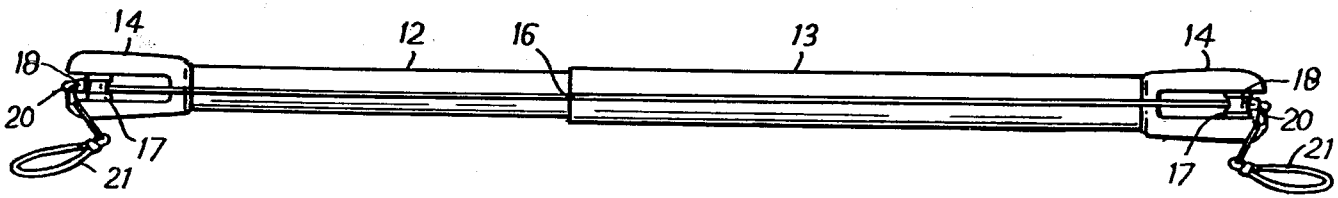
Figure 3A:
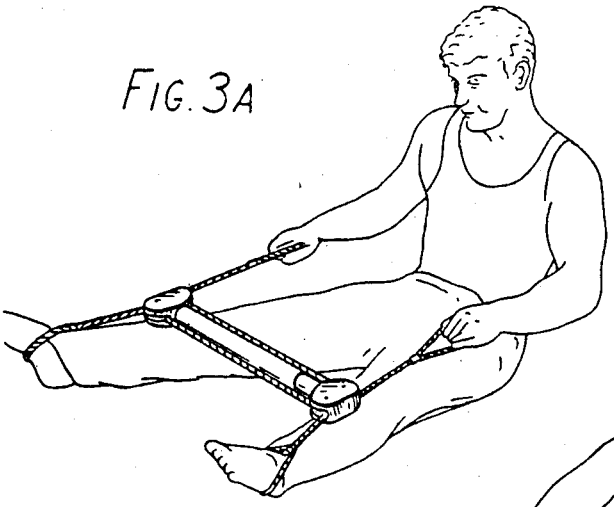
Figure 3B:
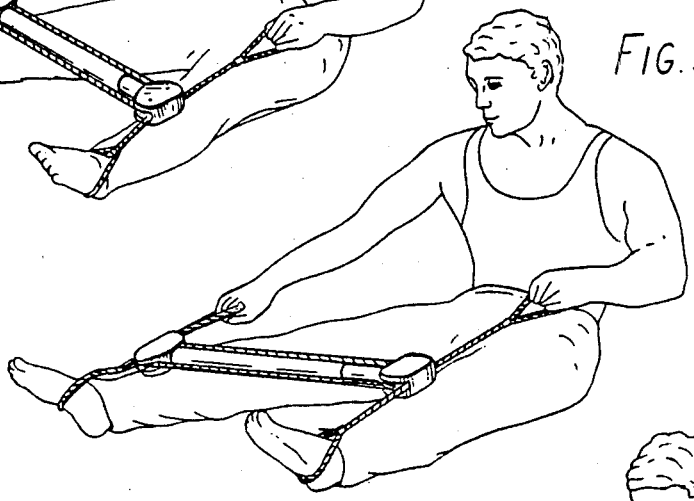
Figure 3C:
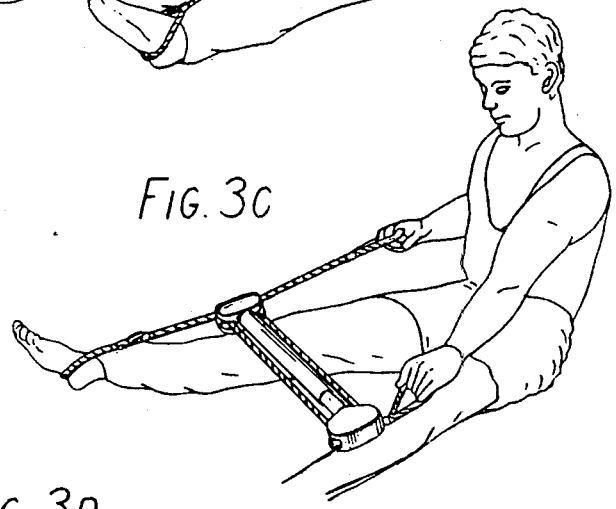
Figure 3D:
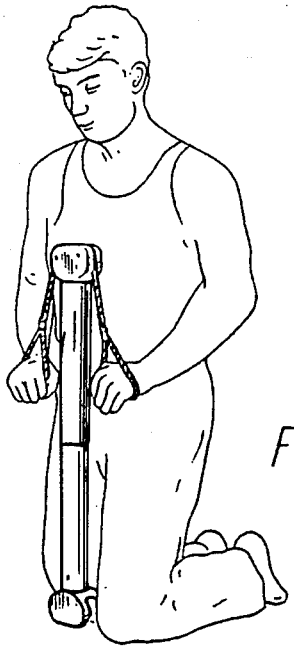
Figure 3E:
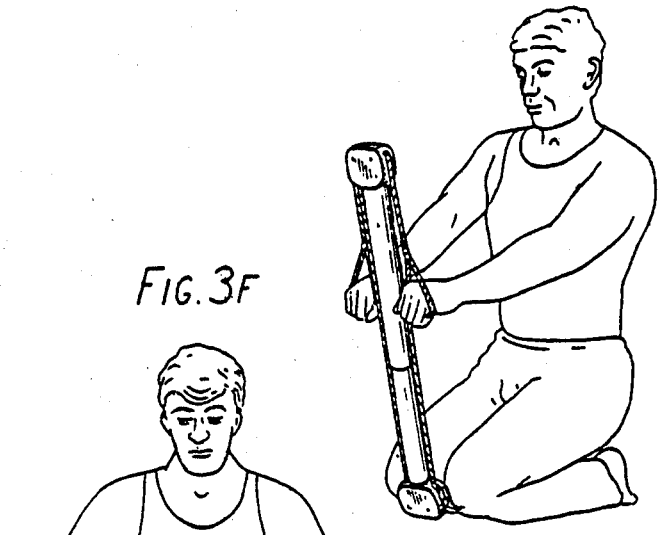
Figure 3F:
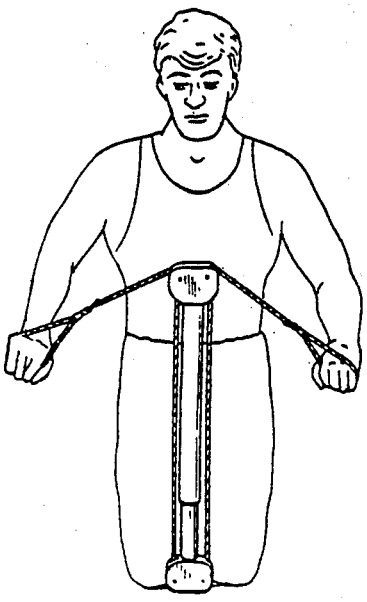
Figure 3G:
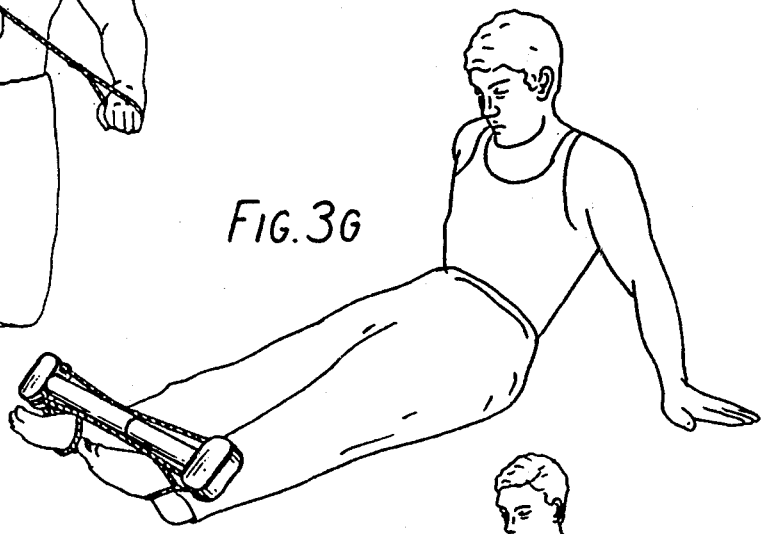
Figure 3H:
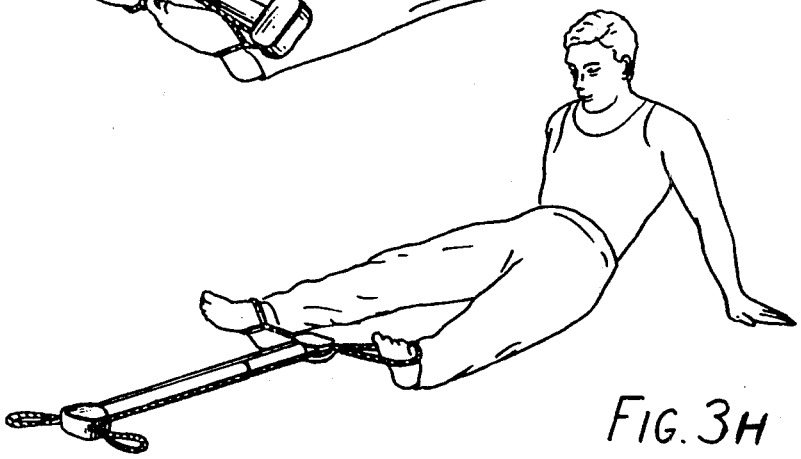
Figure 3I:
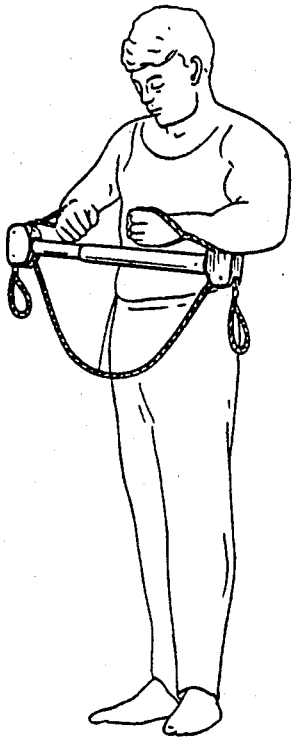
Figure 3N:
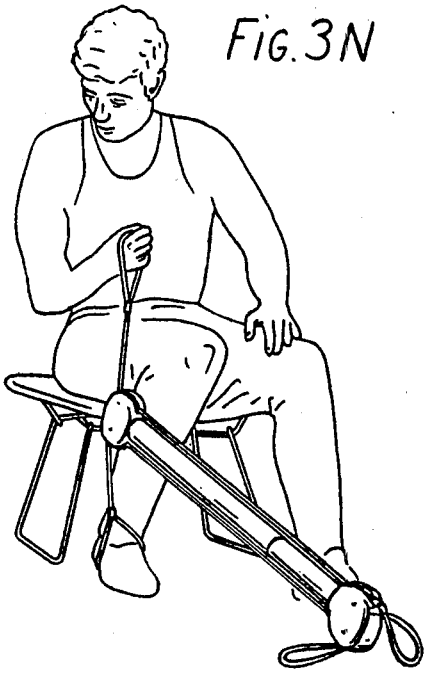

One embodiment of exerciser in accordance with the invention will now be described by way of example only with reference to the accompanying drawings of which FIG. 1 is a plan view of the exerciser, FIG. 2 is a side view of the exerciser of FIG. 1, and FIGS. 3A–3N show diagrammatically some of the additional exercises which can be performed with the exerciser.

Referring first to FIGS. 1 and 2 the exerciser comprises a telescopic system comprising an inner tube 12 slidable within an outer tube 13 and handles 14 at the outer ends of the tubes. Resilient biasing means in the form of a compression spring, indicated diagrammatically at 15, is located within the telescopic system so that it resists contraction of the system. A pair of flexible, substantially inextensible, tension elements 16 extend, each in a single run, between the ends of the system and each end of each tension element passes round a guide member 17 in the form of a pulley mounted in the associated handle and has its end connected to a stop member 18 which prevents the end of the element from moving inwards towards the centre of the system round the pulley. In the rest condition of the exerciser the tension elements 16 will normally be just taut but may be initially under some tension caused by initial compression of the spring 15 in the rest position. The tension elements may be of rope, wire, plastics, or any other suitable material and may be of belt form. Each tension element could extend continuously in more than one run, for example in two or three runs passing round additional pulleys mounted in the handles between adjacent runs. Each stop member 18 is formed by a turned over end of the tension element attached to a ring 20. To each ring 20 is attached an unrestrained pull member 21 in the form of a loop of rope, the attachment being a releasable fastening provided by a clip member 22.

It will be appreciated that pulling on all four or any two or even a single one of the loops will cause the tension elements to pass outwards around the pulleys and effectively contract the system against the action of the biasing means.

Some examples of exercises are shown in FIGS. 3. Referring first to FIGS. 3A and 3B, the feet are inserted in the loops on one side of the exerciser while the hands grip the loops on the other side of the exerciser. Exercises can be performed by pulling with the arms and pushing with the legs. While such an exercise could have been performed on the known exerciser, by inserting the feet through one of the runs and gripping the other run with the arms, the movement distance would not be so great as with the use of the loops nor would the angles at which the legs and arms can be placed be so variable. In addition it is easier with the present exerciser to perform exercises in which sides of the body alternately take the strain as illustrated in the drawings.

FIGS. 3D, E and F show the hands inserted in the loops at one end of the system and performing a pushing exercise. It will be appreciated that the arms can be spaced more widely apart and exercised at different angles of push and pull as illustrated, than with the prior art exerciser where the equivalent exercise could only have been performed with the hands together on the top of the handle and pushing downwards.

FIGS. 3G and 3H show how with the two feet inserted in loops at respectively one side of the exerciser and one end of the exerciser and with the legs at full stretch, the muscles can be exercised while straining the legs together and apart. FIGS. 3I and 3J show similar exercises for the arms.

Figure 3M:
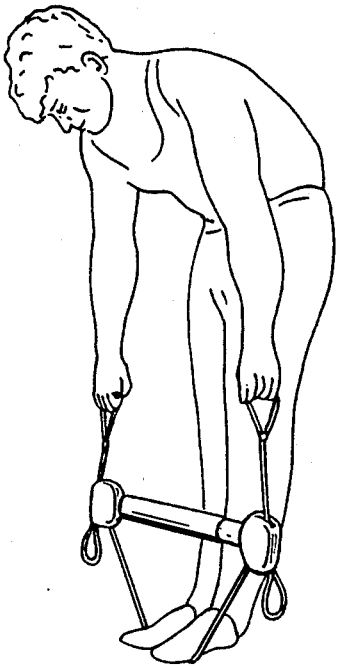

FIGS. 3L and 3J show exercises which can be performed with the arms raised above the shoulders. FIG. 3N shows an exercise for the biceps of one arm in which the exerciser is effectively contracted by the bending movement of one arm and FIG. 3M shows a further exercise involving the back muscles in which the feet are inserted in the run of one tension element while the loops at the ends of the other tension element are gripped by the hands.

Clearly a great many other exercises can be envisaged.

What is claimed is:

1. A physical exerciser for push and pull exercises comprising: an elongate telescopic system having ends, said system being contractable longitudinally by the application of manual pressure; resilient biasing means arranged to resist said longitudinal contraction of said system; a pair of flexible substantially inextensible tension means, said tension means extending longitudinally on opposite sides of the system and connecting said ends of said sytem so that pulling apart of said tension means on opposite sides of said system contracts said system against said biasing means; said tension means having ends, at least two guide members associated with at least two of said tension means ends, said at least two ends each passing round an associated one of said guide members; at least two stop means, one attached to each of said at least two ends and each acting to restrain that end from moving inwards round its associated guide member; and a separate unrestrained pull member connected to each of said at least two ends, such that pulling on a pull member moves the tension means connected thereto around the guide member to contract the system.

2. An exerciser according to claim 1 in which there are four guide members, four stop means and four pull members, each tension means having two ends, each end passing round one of said guide members and being connected to one of said stop means and pull members.

3. An exerciser according to claim 1 in which each said pull member is in the form of a loop.

4. An exerciser according to claim 3 in which said loops are flexible.

5. An exerciser according to claim 1 including releasable fastenings connecting the pull members to said tension element ends.

6. A physical exerciser for push and pull exercises comprising:

an elongate telescopic system having ends, the telescopic system having a normal extended position, said system being contractable longitudinally by the application of manual pressure; resilient biasing means arranged to resist said longitudinal contraction of said system; a pair of flexible substantially inextensible tension means, said tension means extending longitudinally on opposite sides of the system and connecting said ends of said system so that pulling apart of said tension means on opposite sides of said system contracts said system against said biasing means; at least two guide members each mounted adjacent an end of the system, said tension means having parts adjacent said ends of the system passing around the guide members, at least two stop means attached to the tension means, so that they are adjacent said parts passing around the guide members in said extended position, each stop member acting in said position to restrain the associated tension means from moving inwards around the associated guide member, and at least two separate unrestrained pull members connected to said tension means adjacent said stop members such that pulling on a pull member moves the associated tension means connected thereto around the guide member to contract the system.

* * * * *